US006494420B2

(12) United States Patent
Lucero

(10) Patent No.: US 6,494,420 B2
(45) Date of Patent: Dec. 17, 2002

(54) CADDY FOR TEXTURE GUN HAVING A HOPPER

(76) Inventor: Francisco J. Lucero, 1502 Betty La., Las Vegas, NV (US) 89110

( * ) Notice: Subject to any disclaimer, the term of this patent is extended or adjusted under 35 U.S.C. 154(b) by 0 days.

(21) Appl. No.: 09/920,009

(22) Filed: Jul. 31, 2001

(65) Prior Publication Data

US 2002/0014563 A1 Feb. 7, 2002

Related U.S. Application Data

(60) Provisional application No. 60/223,572, filed on Aug. 7, 2000.

(51) Int. Cl.[7] ..... A47K 1/04

(52) U.S. Cl. ..... 248/129; 248/128; 248/907

(58) Field of Search ..... 248/98, 907, 129, 248/153, 128, 146; 280/400, 404, 47.35

(56) References Cited

U.S. PATENT DOCUMENTS 1,102,972 A * 7/1914 Woodworth ..... 248/129
1,559,792 A * 11/1925 Seabold
2,513,630 A * 7/1950 Elliott ..... 211/84
3,292,795 A * 12/1966 Chappell ..... 211/85.19
4,869,518 A * 9/1989 Breveglierij et al. ..... 248/98
4,984,515 A * 1/1991 Pivonka ..... 108/64
5,209,517 A * 5/1993 Shagoury ..... 220/324
5,232,274 A * 8/1993 John et al. ..... 248/101
5,893,469 A * 4/1999 Nozawa ..... 211/126.1
5,996,947 A * 12/1999 Palmieri, III ..... 248/146

* cited by examiner

*Primary Examiner*—Korie Chan
(74) *Attorney, Agent, or Firm*—Weide & Miller, Ltd.

(57) ABSTRACT

A caddy is provided for supporting a hopper, such as a hopper associated with a texture gun. In one embodiment, the caddy includes a base having a top defined by a plate. A first support extends upwardly from a first side of the base and a second support extends upwardly from an opposing second side of the base. A frame is mounted to the first and second supports above the base and is adapted to engage a hopper and support it above the base. In one embodiment, the frame has four sides, three of which are closed, the frame defining a generally open interior area in which a hopper may be located. The fourth side is defined by a pair of stops which extend from opposing sides of the frame, but which have a gap there between. In one embodiment, the base has a semi-circular end having a generally circular opening in the plate which a container may be located. A support or mount is located below a top surface of the plate in which the opening is provided, the mount for supporting a container located placed into the opening. Wheels are connected to the base and extend downwardly from the bottom for rollably supporting the caddy.

4 Claims, 2 Drawing Sheets

CADDY FOR TEXTURE GUN HAVING A HOPPER

This application claims the benefit of Provisional application Ser. No. 60/223,572, filed Aug. 7, 2000.

FIELD OF THE INVENTION

The present invention relates to texture guns, and more specifically a caddy for those guns which include a hopper for containing texture material.

BACKGROUND OF THE INVENTION

It is common to apply any of a variety of coatings or textures to ceilings, walls and other surfaces. In the construction of a home, texture is applied over drywall to form a textured wall surface. A variety of textures may be applied to the ceiling, including those for aesthetic and acoustical purposes.

A variety of devices are available for applying these textures. One such device is a texture gun. The texture gun includes a handle which is gripped by a user. The texture gun includes an inlet through which texture is fed, and an outlet through which texture is sprayed. Means are provided for propelling the incoming texture through the outlet. This means may comprise compressed air provided to the gun through an air hose. A trigger is provided which the operator uses to selectively control the dispensing of the texture.

The texture gun is capable of dispensing large quantities of texture in short periods of time. As such, it is desirable to provide a substantial volume of texture to the gun for application. In one embodiment, a hopper is mounted to the top of the gun. The hopper is generally funnel-shaped, having a large top opening, a holding area, and an outlet. The outlet leads directly to the inlet of the texture gun.

A hopper such as that described may hold several gallons of texture. A significant problem is that it is difficult to fill the texture gun hopper. As is appreciated, it is not generally possible to set the texture gun and hopper on the floor and fill the hopper. The hopper gun is small and narrow, and does not provide a stable support for the hopper. Thus, the hopper gun tends to tip over or otherwise move when one attempts to fill the hopper. Further, the hopper is generally not level when resting on the gun, so that the hopper can not be completely filled.

As a result of these problems, filling the texture hopper is generally a two-man job. One person holds the gun and attached hopper in a fixed and level position. Another person then fills the hopper.

Of course, in some instances, an extra person is not available to aid in this task. In any event, the use of an extra person's time and effort in filling the hopper is not efficient.

Other problems exist with these texture guns with attached hoppers. For example, if the hopper is not empty but the operator needs to cease dispensing texture and engage in another activity, the operator must set the gun and attached hopper down. To avoid having the texture spill from the hopper, the operator must attempt to prop up the texture gun and hopper. The gun often tips or falls over, dumping the texture from the hopper.

Transport of the gun and attached hopper can also be difficult. An operator may need to move from room to room while applying texture. The operator may also need to move associated tools and containers of texture. In some arrangements, the hopper may include a handle for gripping by the operator. However, the handle is generally located at one side of the hopper, so that when gripped the hopper and gun rotate to a non-vertical position. If the hopper is full, texture may spill from the hopper.

A method and device for supporting and moving a texture gun including a texture hopper is desired.

SUMMARY OF THE INVENTION

The present invention comprises a method and apparatus for supporting and transporting a hopper, such as a hopper associated with a texture gun.

In one embodiment, the apparatus comprises a hopper caddy. The hopper caddy includes a base. The base has a top and bottom. The top comprises plate or deck. In one embodiment, a supporting rib extends around a periphery of the plate at the bottom of the base for supporting the plate. The base has generally opposing first and second ends and generally opposing first and second sides. In one embodiment, one of the ends is generally semi-circular in shape.

Means are provided for supporting a hopper above the base. In one embodiment, this means comprises a first support, a second support and an elevated frame supported by the supports. The first support extends upwardly from the first side of the base. The second support extends upwardly from the second side of the base.

The first and second supports both include first and second legs. Each leg has an end connected to the base and another end located above the base. A strut or horizontally extending member extends between the legs of each of the first and second supports. In one embodiment, the first and second supports are configured as inverted "U"-shaped members.

The frame has a first side connected to the strut of the first support and a second side connected to the strut of the second support. A member spans the first and second sides of the frame. In one embodiment, the member connects a first end of the first side and a first end of the second side. A stop extends from a second end of the first side and another stop extends from a second end of the second side of the frame. In one embodiment, the two stops extend inwardly towards one another along a line which is generally parallel to the member at the first ends of the sides. So configured, the frame is generally "U" or "C" shaped, having a periphery substantially surrounding a generally open area which a hopper may be located.

In one embodiment, means are provided for rollably supporting the caddy. In one embodiment, four wheels are connected to the base and extend downwardly from the bottom of the base.

In one embodiment, the caddy includes a container support adapted to support a container. In one embodiment, the container support includes an opening in the plate or deck of the base through which a container may be placed, and a support or mount located below the top of the plate for supporting a container located in the opening.

In one embodiment, a lip extends downwardly from the periphery of the opening at the top of the plate or deck. The mount comprises a "+" shaped member located at the bottom of the lip.

In accordance with the invention, a hopper, such as a hopper associated with the texture gun, may be supported in a stable and secure position above the base of the caddy. As supported, material may be placed on the frame and loaded into the hopper. The hopper may also be transported by moving the caddy.

A container, such as a bucket of texture, may also be supported by the caddy. The container may be used to hold texture which is poured into the hopper.

Further objects, features, and advantages of the present invention over the prior art will become apparent from the detailed description of the drawings which follows, when considered with the attached figures.

DETAILED DESCRIPTION OF THE INVENTION

The invention is a method and apparatus for supporting and transporting a texture gun which includes a hopper. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

Figure 1:
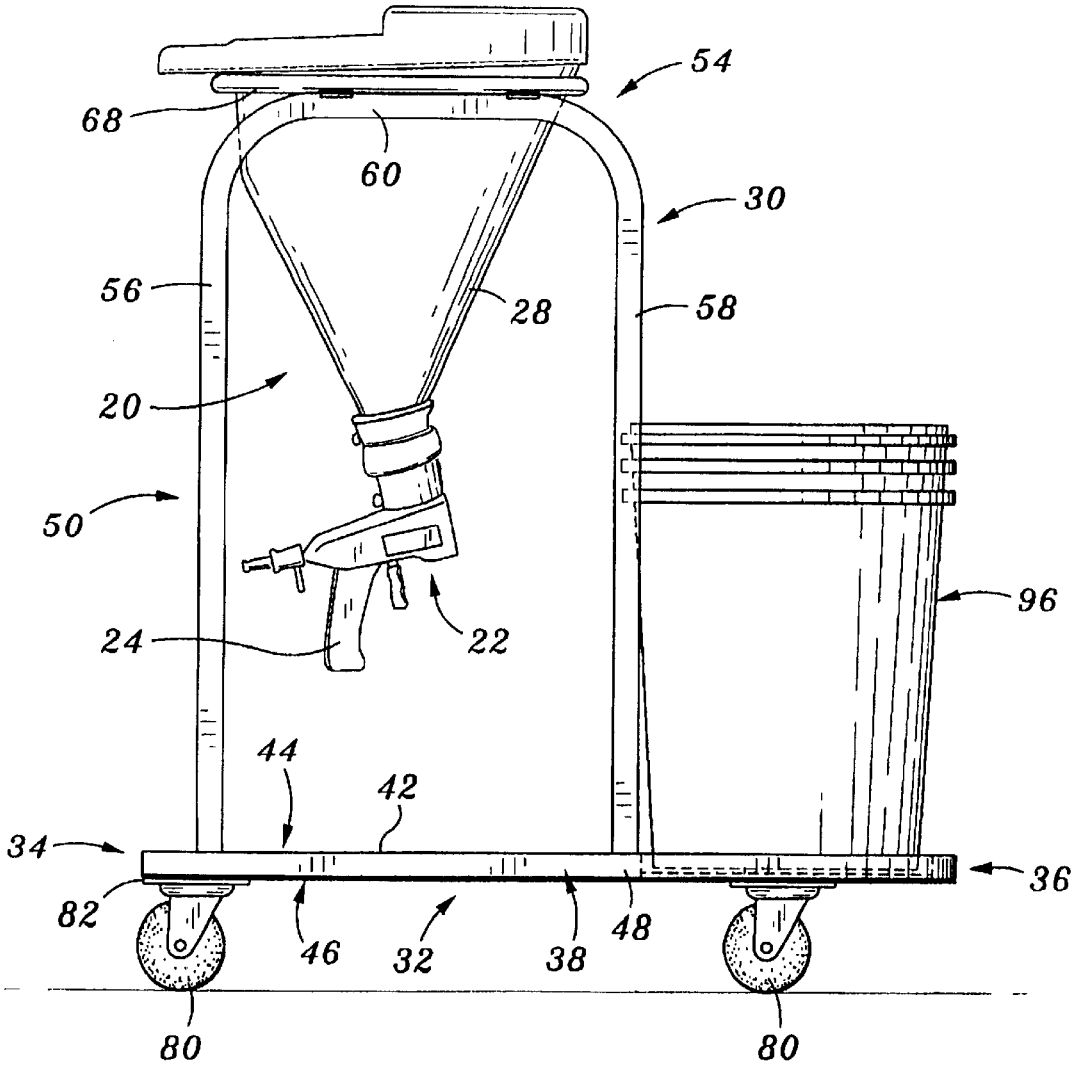
FIG. 1 is a side view of a caddy of the present invention illustrated as supporting a texture gun and associated hopper as well as a container.

In general, the present invention comprises a hopper caddy for supporting and transporting a texture gun having a hopper. An example of such a texture gun 20 is illustrated in FIG. 1. As illustrated, the texture gun 20 includes a dispenser 22. The dispenser 22 includes a handle 24 for gripping by an operator. The dispenser 22 also includes a trigger device 26 which actuates a means for propelling texture from the dispenser.

A hopper 26 is connected to the dispenser 22. In one embodiment, the hopper 26 is defined by a perimeter wall 28. At a top portion opposite its connection with the dispenser 22, the hopper 26 has a generally square perimeter wall shape. At a lower portion at its connection with the dispenser 22 the wall defines a generally circular funnel-shaped outlet. The outlet of the hopper 26 is connected to an inlet of the dispenser 22.

The hopper 26 defines an interior area for containing material such as wall texture. For this reason, the hopper 26 may be referred to as a materials or texture hopper.

It will be appreciated that the texture gun 20 may have a wide variety of configurations other than that described and illustrated. The manner of operation of the gun 20, the shape and size of the hopper 26 and a number of other characteristics of the gun may vary.

In accordance with one embodiment of the invention, there is provided a hopper caddy 30 for supporting and transporting the texture gun 20, including its hopper 26. In general, the hopper caddy 30 comprises a support or platform which supports a raised frame. The frame is designed to support a hopper 26 in a raised and level position. The hopper caddy 30 is preferably movable for transporting a supported hopper 26 and associated dispenser 22.

Figure 2:
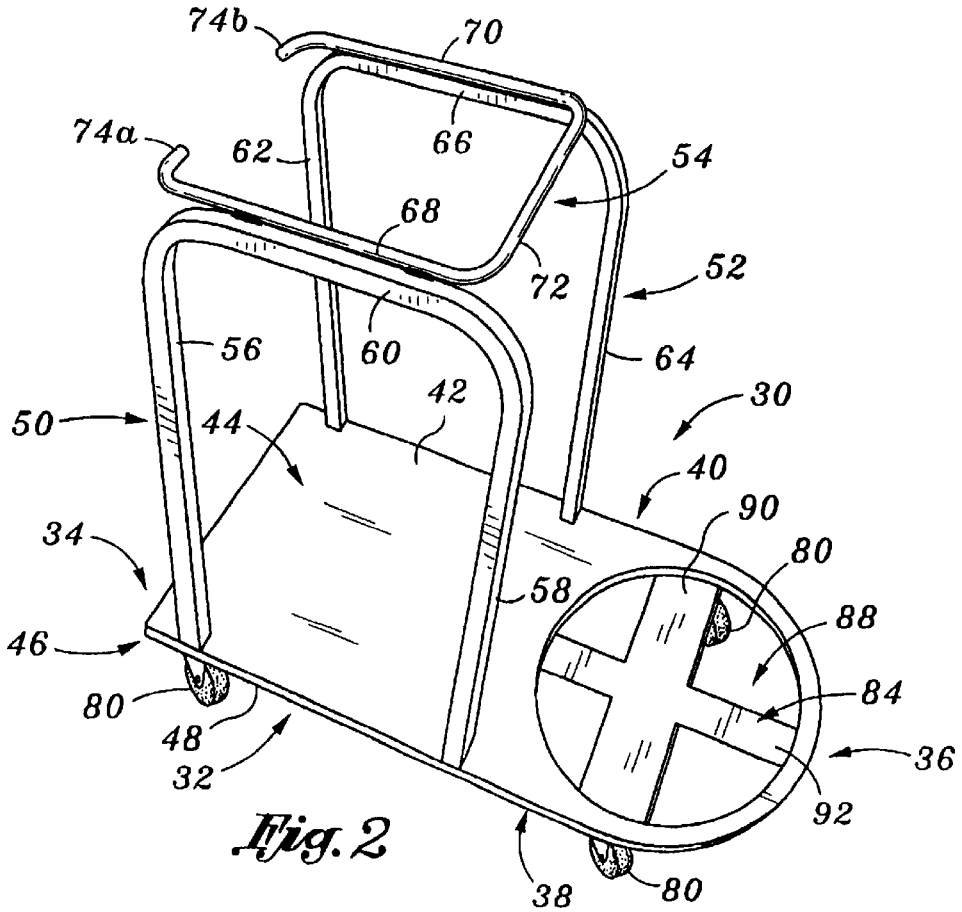
FIG. 2 is a first perspective view of the caddy illustrated in FIG. 1.

An embodiment of the hopper caddy 30 will now be described in detail with reference to FIGS. 1–3. Referring first to FIG. 2, the hopper caddy 30 includes a base or platform 32. The base 32 has a first end 34, a second end 36, and a first side 38 and a second side 40.

As best illustrated in FIG. 1, in one embodiment, the base 32 is generally planar. Referring to FIG. 2, the first and second sides 38,40 extend generally perpendicularly to the first end 34. The first and second sides 38,40 extend generally parallel to one another. In a preferred embodiment, for reasons disclosed in more detail below, the second end 36 of the base 32 has a semi-circular shape.

The base 32 may have a wide variety of constructions. The base 32 has a top 44 and a bottom 46. In one embodiment, the top 44 of the base 32 is defined by a generally flat plate 42 or deck.

In one embodiment, a rib 48 extends around the periphery of the plate 42 at the bottom of the base 32. The rib 48 may comprise an element which is connected to the plate 42, or be formed integrally therewith.

In one embodiment, the plate 42 is constructed of a rigid and durable material, such as steel. The steel may be painted to protect it and improve the aesthetic appeal of the caddy 30. In one embodiment, the rib 48 comprises 0.75 inch square tubing which is welded to the steel plate 42.

Means are provided for supporting a texture gun 20 including attached hopper 26 in an elevated position above the base 32. In one embodiment, this means comprises a support structure which extends upwardly from the base 32.

Referring to FIG. 2, in one embodiment, the support structure comprises a first support 50 and a second support 52 which support an elevated frame 54. The first support 50 is located near the first side 38 of the base 32, and the second support 50 is located near the second side 40 of the base.

In one embodiment, the first support 50 has a first leg 56 and a second leg 58. A first end of the first leg 56 and second leg 58 is connected to the base 32 near its first side 38. The first ends of the first and second legs 56,58 are spaced from one another. The legs 56,58 extend upwardly generally perpendicular to the plate 42. In one embodiment, the legs 56,58 tilt inwardly towards one another to increase the load bearing capacity of the support 50.

A second end of each leg 56,58 is positioned above the base 32. A strut 60 extends between the second end of the first leg 56 and the second end of the second leg 58.

In one embodiment, the strut 60 is positioned above the base 32 approximately 24 inches. Thus, the first and second legs 56,58 are approximately 20–24 inches long from end-to-end. In one embodiment, the strut 60 is approximately 10–12 inches long. Thus, the first and second legs 56,58 are spaced approximately 12–14 inches apart from one another. Preferably, all or substantially all of the strut 60 extends horizontally, generally parallel to the plate 42.

The legs 56,58 and strut 60 may be constructed from a wide variety of materials. In one embodiment, the legs 56,58 and strut 60 are constructed from 0.75 inch square tubular steel. In this embodiment, the legs 56,58 may be connected to the base 32 by welding. The legs 56,58 and strut 60 may be constructed as a singular element, as illustrated in FIGS. 1–3 in the form of an inverted "U"-shaped element.

In one embodiment, the second support 52 is similar to the first support 50. The second support includes a first leg 62 and a second leg 64. The first and second legs 62,64 each have a first end which is connected to the base 32 near its second side 40. A strut 66 extends between the first and second legs 62,64. The configuration and construction off the support 52 may be as described above with respect to the first support.

Preferably, the first leg 56 of the first support 50 and the first leg 62 of the second support 52 are positioned approximately the same distance along the respective first and second sides 38,40 from the first end 34 of the base 32. Likewise, the first leg 58 of the first support 50 and the first leg 66 of the second support 52 are positioned approximately the same distance along the respective first and second sides 38,40 from the first end 34 of the base 32. In other words, the first and second supports 50,52 are generally aligned with one another.

In one embodiment, the frame 54 comprises a generally "C" or "U"-shaped member which is supported by the first and second supports 50,52. The frame 54 includes a first side 68, a second side 70, an end 72 extending between the sides 68,70, and in one embodiment, at least one stop.

The first side 68 extends along the strut 60 of the first support 50 and is supported thereby. The second side 70 extends along the strut 66 of the second support 52 and is supported thereby. The end 72 comprises a member or element which extends between the first and second sides 68,70 of the frame 54, preferably generally spanning the distance between the second leg 58 of the first support 50 and the second leg 64 of the second support 52.

In one embodiment, a first stop 74*a* extends from the first side 68 of the frame 54 generally opposite its end 72. The stop 74*a* extends inwardly towards the second support 52. A second stop 74*b* extends from the second side 70 of the frame 54 generally opposite its end 72. The second stop 74*b* extends inwardly towards the second support 52. Preferably, free ends of the first and second stops 74*a,b* are separated by a gap.

The frame 54 may be constructed of a wide variety of materials. In one embodiment, the frame 54 is constructed of circular steel rod. In such arrangement, the frame 54 may be connected to the support 50,52 by welding.

As described, the first side 68, second side 70, end 72 and stops 74*a,b* define a generally peripheral support or frame. The frame 54 is open in its interior area for accepting the hopper of a texture gun therein, as described in more detail below.

In one embodiment, means are provided for rollably supporting the base 32 of the caddy 30. In a preferred embodiment, a plurality of wheels 80 are provided for this purpose.

Referring to FIG. 2, in one embodiment, the caddy 30 includes four wheels 80. Wheels 80 are located near the corners of the base 32 at the intersections of the sides 36,38 with the first end 34. Wheels 80 are also located near the second end 36.

The wheels 80 may be of a variety of types and be associated with the caddy 30 in a number of manners. In one embodiment, a mount 82 is located at the corners of the base 32 at the intersections of the sides 36,38 with the first end 34. The mounts 82 are generally planar members connected to the rib 48. A wheel 80 is connected to each mount 82.

In one embodiment, the wheels 80 each have a supporting frame and axle. A tire or wheel is mounted on the axle.

In one embodiment, the wheels 80 located near the second end 36 of the base 32 are also mounted to a supporting member or mount 84. This mount 84 comprises a portion of a container support, as described below.

In one embodiment, the hopper caddy 30 includes a container support. In a preferred embodiment, the support comprises an opening 88 in the plate 42 or deck. In one embodiment, the opening 88 is generally circular and sized to accept the base of a 5 gallon bucket.

Figure 3:
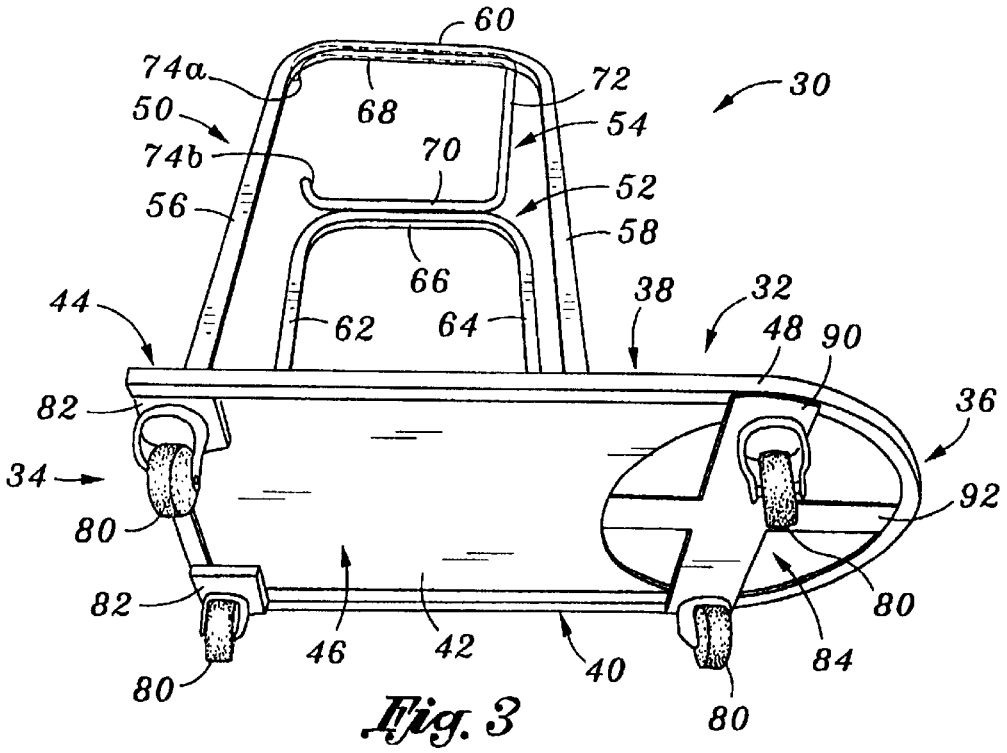
FIG. 3 is a second perspective view of the caddy illustrated in FIG. 1 .

Referring to FIGS. 2 and 3, means are provided for supporting a container placed in the opening 88. In one embodiment, this means comprises a mount 84 which is located below the top 44 of the base 32. In one embodiment, the mount 84 includes a first cross-member 90 which extends from the first side 38 to the second side 40 of the base 32. The first cross-member 90 is aligned with the opening 88, spanning the space below the opening. A second cross-member 92 extends generally perpendicular to the first cross-member 90 and is also aligned with the opening 88, but located below it.

So arranged, the mount 84 has a "+" configuration. In one embodiment, each cross-member 90,92 comprises a generally flat plate member having a width of about 2–3 inches.

In one embodiment, a lip extends downwardly from the plate 42 and defines a periphery of the opening 88. The mount 84 is located at the bottom of the lip.

It is contemplated that the caddy 30 may be configured other than as described above. The plate 42 need not comprise a planar member nor include a generally solid plate. For example, the plate 42 may comprise expanded metal. In one embodiment, the base 32 comprises an open frame without a plate 42.

If the plate 42 is sufficiently rigid, the rib 48 may be omitted. Alternatively, the base 32 may be include a variety of other elements, such as ribs which extend from side to side or.end to end to increase the strength thereof.

The base 32 need not have the exact shape as described. For example, if the caddy 30 does not include a container support, the base 32 may be generally square or rectangular in shape.

In one embodiment, the frame 54 may be supported above the base 32 by other than the supports 52,54 as described. For example, the supports may include more than one leg or greater than two legs. The supports may comprise generally solid walls which extend upwardly from the base 32. The supports may have a single leg and have a "T" shape.

The frame 54 may be other than as described. For example, the frame 54 may include portions of the first and second supports 52,54. The frame 54 may comprise the two struts 60,66 and a member extending between the two struts 60,66 in similar fashion to the end 72 of the frame 54 as illustrated. The frame 54 may be connected to other than the struts 60,66 such as the legs of the supports 50,52 below the struts. In such an arrangement, the struts may also be omitted.

In general, it is desirable for the frame 54 to include at least two members for supporting opposing portions of a hopper. More desirably, the frame 54 is arranged to support at least three sides or portions of a hopper.

In one embodiment, the first and second supports 50,52 and frame 54 may be combined. For example, the entire supporting structure may comprise a generally "C" shaped wall which extends upwardly and has a top edge for supporting a hopper.

The frame 54 may be shaped or sized differently depending on upon the size and shape of a hopper to be supported. For example, if the hopper to be supported has a conically-shaped wall, the 54 may define a generally circular peripheral support.

As noted, the frame 54 is sized to engage a wall portion of a hopper. Thus, the lengths of the sides 68,70 and end 72 may vary dependant upon the size o the hopper to be supported.

The caddy 30 need not include wheels. Instead of four wheels, the caddy 30 may have as few as three or more than four wheels. The wheels need not be configured exactly as described. For example, wheels having a large diameter may be located near the first end 34 of the base 32. Casters or smaller wheels may be located towards the second end 36 of the base 32.

Members other than wheels may be used to rollably support the caddy 30. For example, the base 32 may be supported on tracks.

The container support need not be configured as described. For example, the container support may comprise a member or members which extend upwardly from the plate 42 and define a container accepting/retaining structure. For example, a short wall may extend upwardly from the plate 42 and define a peripheral stop in which the container may be placed.

The container support may be configured to accept containers of other sizes and dimensions than as described. For example, the container support may be configured with a generally square opening for mating with a square container.

One or more elements of the caddy 30 may be combined into a single element (such as integral formation) or divided into additional elements. The elements of the caddy 30 may be connected by a variety of means, such as welding, nuts and bolts or other elements.

Use of the hopper caddy 30 as described above and illustrated in FIGS. 1–3 will now be described in detail. A hopper 26, either alone or as connected to a texture gun 20, may be supported by the caddy 30. It will be appreciated that while the invention is particularly suited to supporting a hopper associated with a texture gun, other hoppers or containers (including those not associated with a texture gun/dispenser) may be supported. In use, the hopper 26 is placed on the frame 54, where it is supported.above the base 32 as illustrated in FIG. 1.

The hopper 26 may be lowered onto the frame 54 from above, in the direction of the base 32. In the preferred embodiment illustrated, the hopper 26 may also be directed into the spaced defined by the frame 54 by passing it between the opposing stops 74*a,b*, and then lowering it completely into a resting position on the frame 54.

When positioned on the frame 54, the frame 54 supports the hopper 26. In particular, the first and second sides 68,70, end 72 and stops 74*a,b* generally encircle the hopper 26 below its top edge. In a preferred embodiment, the caddy 30 is particularly adapted to support a hopper 26 configured as described above as including a wall which defines a generally square perimeter, the hopper having its largest dimension at an open top and which reduces in dimension towards its bottom or outlet end. In this arrangement, the frame 54 has portions engaging each of the four sides of the hopper 26. The hopper 26 sits in the opening defined by the frame 54 to a point at which the size of the hopper 26 prevents the hopper 26 from moving downwardly with respect to the frame 54.

When positioned on the frame 54, the hopper 26 is supported in a level position with its open top facing upward. Texture and other material may be poured or directed into the hopper 26 when the hopper 26 is in this position.

Because the hopper 26 is supported above the base 32, the hopper 26 does not engage the base 32. Preferably, the hopper 26 is supported sufficiently above the base 32 that a texture gun dispenser 22 connected to the bottom or outlet of the hopper 26 is also supported above the base 32.

As also illustrated in FIG. 1, a container 96 may be placed on the caddy 30. In one embodiment, the container preferably comprises a bucket, such as the well-known 5 gallon bucket having a generally circular perimeter shape. The container may be used to hold texture or other material which is to be placed in the hopper 26.

In a preferred embodiment, the container is positioned in the container support. In particular, the container is lowered into the opening 88 until the base of the container rests upon the mount 84. Because the mount 84 is located below the top 44 of the plate 42, the plate 42 surrounds a portion of the container, maintaining it in position.

The caddy 30 may be moved. The caddy 30, either empty or as supporting either or both of a hopper 26 and container, may be rolled from one place to another using the wheels 80.

The hopper caddy 30 of the present invention has numerous advantages. First, the caddy 30 is arranged to support a hopper, such as a texture hopper, in a stable and secure position. Texture or other material may be loaded into the hopper by a single person. The hopper is maintained in a level position so that material located in the hopper does not spill out.

Because the hopper is held in a secure position, a user need not hold onto the hopper. This frees the user's hands to engage in other activities, such as holding a container and pouring texture or other material into the hopper.

The container support is adapted to support a container on the caddy 30. A user may locate a container of texture, water or other material on the caddy 30. Material may be moved from the container to a hopper supported by the caddy.

A user may easily transport a hopper and/or a container with the caddy 30. A hopper located on the caddy 30 is held in a secure position, and is not permitted to move. The hopper is held in a level position so that material does not spill or flow from its open top. A container is held securely in the container support, and also prevented from falling from the caddy 30.

As one aspect of the invention, a hopper may easily be located on the frame. In the preferred embodiment, a hopper may be lowered into engagement with the frame. Alternatively, a portion of the hopper may be passed between the stops of the frame and then lowered into engagement with the frame. As will be appreciated, in the latter case, the height to which the hopper may need to be raised to place the hopper into engagement with the frame is substantially reduced. This may be important in the event the hopper is tall and a texture gun is connected to its lower end. In addition, if loaded, the hopper may be heavy. Likewise, a loaded hopper is more easily removed by slightly raising the hopper from the frame and then passing the hopper between the stops. At the same time, the two stops define member which aid in securely engaging a fourth side of the hopper to prevent undesirable movement of the hopper from the frame 54.

The hopper caddy 30 in accordance with the invention solves the problems associated with using a hopper, such as that of a texture gun, of the prior art.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A caddy for supporting a hopper for use with a texture gun comprising:

a base, said base having a top and a bottom, a first end and a generally opposing a second end, a first side and a generally opposing second side;

a hopper support structure positioned nearer said first end than said second end of said base, said hopper support structure comprising:

a first support extending upwardly from said base, said first support having an inverted "U"-shape, said first support including a first leg having a first end connected to said base and a second leg having a first end connected to said base, said first leg and said second leg spaced apart, and a strut connecting a second end of said first leg and a second end of said second leg, said strut extending generally horizontal to said base and positioned vertically above said base;

a second support extending upwardly from said base, said second support having an inverted "U"-shape, said second support including a first leg having a first end connected to said base and a second leg having a first end connected to said base, said first leg and said second leg spaced apart, and a strut connecting a second end of said first leg and a second end of said second leg, said strut extending generally horizontal to said base and positioned vertically above said base, said first and second supports positioned at generally opposing sides of said base;

a frame mounted to said first and second supports and supported above said base, said frame including a first side extending along said strut of said first support, a second side extending along said strut of said second support, a cross-member extending between a first end of each of said first and second sides of said frame and spanning a space between said first and second supports, a first stop extending inwardly from a second end of said first side of said frame a second stop extending inwardly from a second end of said second side of said frame, said first and second stops terminating with a gap therebetween through which a portion of a hopper may be extended into an interior defined by said frame, said frame supporting said hopper above said base by engaging said hopper when said hopper is located within said interior and lowered into engagement with said frame, at least a portion of said hopper located in an open space defined below said frame, above said base and between said first and second supports;

a container support, said container support located at said second end of said base, said container support comprising an opening in said top of said base for accepting a container therein and a mount located below said top of said base for supporting a container positioned in said opening; and a plurality of wheels connected to said bottom of said base adapted to rollably contact a supporting surface.

2. The caddy in accordance with claim 1, wherein said base has a semi-circular second end.

3. The caddy in accordance with claim 1, wherein said base comprises a generally planar deck and at least one rib positioned at said bottom of said base supporting said planar deck.

4. The caddy in accordance with claim 3 wherein said rib extends along the periphery of said planar deck.

* * * * *